United States Patent [19]

Gergö et al.

[11] Patent Number: 4,498,391

[45] Date of Patent: Feb. 12, 1985

[54] EXPLOSIVE MINE BREAKING APPARATUS WITH ARC-SUPPRESSING HEAT-DISSIPATING FLUID AROUND THE CHARGE BODIES

[75] Inventors: György Gergö, Pécs; József Németh, Budapest; Béla Sebestyén; Béla Solymossy, both of Pécs, all of Hungary

[73] Assignee: Mecseki Szénbányák, Komját Aladár, Hungary

[21] Appl. No.: 500,294

[22] Filed: Jun. 2, 1983

[30] Foreign Application Priority Data

Jun. 4, 1982 [HU] Hungary ..... 1810/82

[51] Int. Cl.[3] ..... F42D 3/00

[52] U.S. Cl. ..... 102/312; 102/313; 102/316; 102/320; 102/331; 166/63; 175/4.55; 299/12; 299/13

[58] Field of Search ..... 102/312, 313, 316, 320, 102/325, 331; 299/4, 5, 12, 13; 106/63; 175/4.55

[56] References Cited

U.S. PATENT DOCUMENTS

| | | | |
|---|---|---|---|
| 3,648,614 | 3/1972 | Berthmann et al. | 102/316 X |
| 4,079,675 | 3/1978 | Buemel, Jr. | 102/401 |
| 4,284,306 | 8/1981 | Edmonds et al. | 299/5 |
| 4,411,474 | 10/1983 | Higgins | 299/4 |
| 4,417,992 | 11/1983 | Bhattacharyya et al. | 299/12 X |

*Primary Examiner*—Peter A. Nelson

*Attorney, Agent, or Firm*—Karl F. Ross; Herbert Dubno

[57] ABSTRACT

Steep dip strong-coal deposits can be broken in an explosive mine environment utilizing a succession of explosive units each of which comprises a core tube surrounded by a body of explosive material which, in turn, is surrounded by an arc-suppressing heat-dissipating fluid. Igniters in the explosive charges have conductors which are lead back out of the bore hole through the tubes of the explosive units which are anchored at spaced locations along the bore hole.

3 Claims, 2 Drawing Figures

EXPLOSIVE MINE BREAKING APPARATUS WITH ARC-SUPPRESSING HEAT-DISSIPATING FLUID AROUND THE CHARGE BODIES

FIELD OF THE INVENTION

The invention relates to a mine-breaking apparatus and, more particularly, for breaking steep dip strong coal deposits by explosion using by high mass blasting charges, in damps and hot and coal dust-explosive environment.

BACKGROUND OF THE INVENTION

In damps, hot and coal-dust mines with a high explosion risk or in steep dip stopes, especially in the case of strong coal, the breaking of coal layers at higher levels (i.e. a height of 6 m or more above the entry), can not be realized by the damp-free breaking methods applied up till now.

Also by injection and long hole high pressure air breaking, as a rule, only a section of 5–6 m length above the entry tears away, and consequently, also the immediate top wall above the broken ground tears away after a brief time, the top wall detritus soiling the already broken coal and the incipient caving impedes the further breaking the coal mass above the ripping.

The breaking coal by conventional brizant explosives (i.e. by those with violent effect) can not be used at all for reasons of safety. The breaking by conventional "damp-proof" explosives can be realized on the same grounds only applying blasting charges of small mass, but this method is not satisfactory for the breaking of strong coal in a great mass. The blasting charge containing explosives identified as damp-proof explosives also cannot be applied in a great mass in the case of steep dip coal deposits because the coal wall surrounding the bore hole can tear out and the blasting charge previously set can fire the damp medium in the region.

OBJECT OF THE INVENTION

The object of the invention is to provide an apparatus for explosion breaking steep dip strong coal deposits within an explosion-danger medium, which enables the economical, effective and at the same time safe breaking of these coal deposits with the least possible losses in the coal resources.

SUMMARY OF THE INVENTION

The invention is based in the first place on the discovery that by encircling the explosive by an arc suppressing medium, during detonation or rather as a consequence of it, during development of the considerable explosion temperature the arc suppressing medium, on one hand, as a high pressure, closed barrier encircles the high temperature zone and the breeding arc, keeps off the lower pressure detonating gas-air and/or coal dust-air composition, thereby impeding the oxygen supply to the high temperature zone and to the breeding arc, dissipating of the closed protective barrier. According to the invention at least one hole is bored in the (coal) deposit to be broken, and a high mass blasting charge will be inlayed, encircled by a heat dissipating, arc suppressing medium, e.g. by aqueous solution of magnesium chloride. This blasting charge is fixed in the bored hole in a convenient place, then the blasting charge encircled by the arc suppressing medium is fired under damp-proof condition, influenced by the protective medium brought about by the arc suppressing medium and the loosened mineral (coal) will be broken.

According to the invention it is also advantageous if a plurality of blasting charges are inlayed in one bore hole and are fixed in distances ensuring their range of effect without overlap and the firing is executed in series.

The explosion apparatus of the invention has an inner chamber suitable for inlaying the explosive which chamber can be closed and has a central recess and is encircled by at least one outer chamber for containing a heat dissipating and arc suppressing medium, and an igniter embedded in the explosive; the detonating end of the said igniter is carried out through the central recess which has a through aperture.

Advantageously a spring holding extension is fastened to the bottom of the apparatus; this spring holding is suitable for receiving a supporting spring and is functionally connected with a push bar top, which top when being pushed forward holds the supporting spring in clamped position and upon being drawn backward releases the same supporting spring.

BRIEF DESCRIPTION OF THE DRAWING

In order that the invention may be clearly understood, it will be described, by way of example, with reference to the accompanying drawing, in which.

SPECIFIC DESCRIPTION

Figure 1:
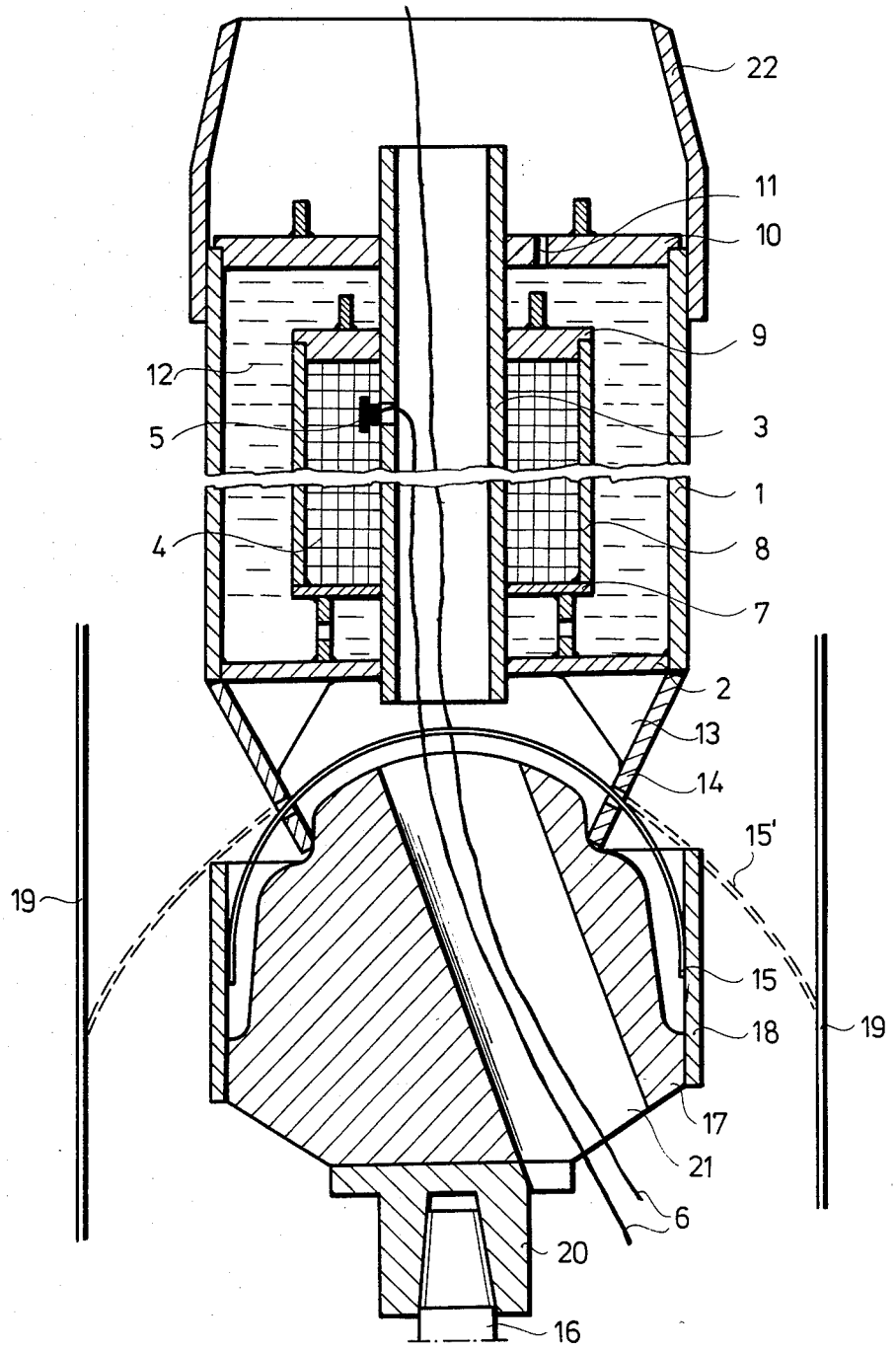
FIG. 1 is a longitudinal axial section of the explosion apparatus and of the push bar joint according to the invention.

Referring to FIG. 1, the cylindrical jacket of the explosion apparatus according to the invention is formed by an outer pipe 1 that is connected by a lower closing disc 2 with an inner pipe 3, which surrounds the explosive 4 along its inside circumference and forms a central through aperture through the explosion apparatus. This central through aperture serves in the same time to enabling the eduction of the detonating cord 6 of the igniter 5 embedded in the explosive 4 through the explosion apparatus to the detonating station.

An intermediate pipe 8 is connected through an inner closing disc 7 rigidly fastened on it to the inner pipe 3. This pipe 8 surrounds the explosive along its outer circumference and so, together with inner pipe 3 and the inner closing disc 7, forms a chamber receiving the explosive 4. After filling, the chamber receiving the explosive 4 will be closed by a disc 9. An upper closing disc 10 is connected to the upper end surface of the outer pipe 1 and to the cylinder mantle of the inner pipe 3, and this closing disc 10 has a bore 11 for venting the air. Thus a chamber is brought about which surrounds the explosive 4 on all sides and which is suitable to receiving the heat dissipating and arc supressing medium 12. This chamber is limited by the pipes 1, 3 and 8, further by the closing discs 2, 7, 9 and 10. The heat dissipating and arc suppressing medium 12 can be an aqueous solution of magnesium chloride or other known material suitable for executing similar functions.

To the lower cylinder jacket of the outer pipe 1 and to the end surface of the flanged lower closing disc 2, a spring-supporting extension 14 strengthened by ribs 13 is fastened, in which extension a curved bent supporting spring 15 is arranged. The ends of supporting spring 15 hanging out from the spring supporting extension 14 are clamped within the spring bearing ring 18 which is bolted to the top 17 of a push bar 16 serving for pushing the explosion apparatus to its place. After releasing, the ends of supporting ring 15 spread apart, open to the position 15' and fasten the explosion apparatus in the required position locked to the wall in the bore hole 19. The push bar 16 joins to the lower end surface of the push bar top 17 through a spacer 20. In the push bar top 17, a through bore 21 is prepared for passed the detonating cords 6. To facilitate pushing of the unit up the bore hole 19, conical guide bush 22 is connected to the upper cylinder jacket of the cylindrical outer pipe 1.

Figure 2:
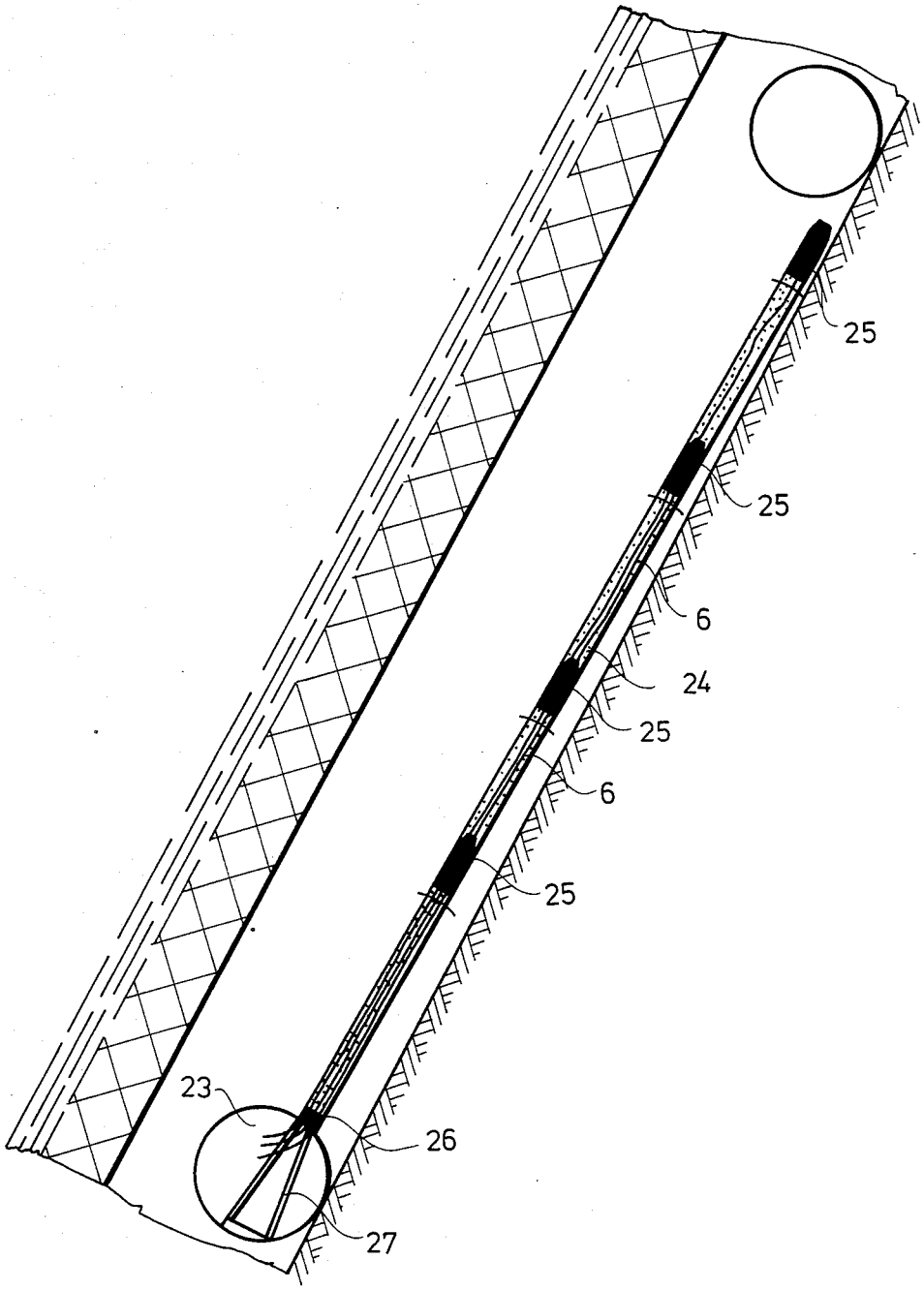
FIG. 2 is a diagram which illustrates the apparatus according to the invention, arranged in a hole bored in steep dip coal deposit.

A plurality of explosion apparatuses (blasting charges) arranged in the same bore hole are illustrated on FIG. 2. As is seen from the drawing, the blasting charges 25 are arranged in definite spacing in the bore hole 24 which is starting out from the lower entry 23 of a steep dip deposit. These blasting charges 25 are fixed on the required place by the supporting spring 15 known from FIG. 1. The spacing of the blasting charges 25 is defined by the condition that their ranges of effect should meet without overlap. The choking required for the explosion breaking in the bore hole 24 is performed by the choking plug 26, on which an educting bore is formed for educting all detonating cords 6 and a connecting bore is formed for the filler (loading set) required for choking. The fixing of the choking plug 26 is accomplished by a supporting set (sprag) 27 which consists of a wedge and a prop.

The method according to the invention is executed by the described explosion apparatus as follows:

The explosive 4 and the igniter 5 will be set in the chamber surrounded by the pipe 3, intermediate pipe 8 and inner closing disc 7. The detonating cord 6 of the igniter 5 will be educted through the aperture in the wall of the inner pipe 3 and through this pipe 3, and will be fastened in an orifice on the spring support extension 14 which orifice receives the supporting spring 15, then the cord 6 will be drawn through the through-hole 21 of the push bar top 17. The explosive 4 inlayed in the chamber will be closed by the closing disc 9, then the chamber surrounded by the outer pipe 1, inner pipe 3 and intermediate pipe 8, further by the closing discs 2, 7 and 9 will be filled by heat dissipating and arc uppressing medium 12 and closed by closing disc 10. After that, the cone guide bush 22, enabling the pushing up without jamming, will be applied to the cylinder jacket of the outer pipe 1. Then the ends of the supporting spring 15 will be clamped in the push bar top 17, respectively in the spring bearing ring 18, and the spacer 20 will be fastened by bolts on the push bar top 17, the extensible push bar 16 will be screwed-on in the spacer 20, and the explosion apparatus (blasting charges) will be pushed to the required place. Pulling back the push bar 16, the supporting spring slides out from the spring bearing ring 18 and will be clamped by the wall of the bore hole 19. Thus, the blasting charge will be fixed.

Applying more explosion apparatuses, firstly the detonating cords of the already pushed up and fixed blasting charge 25 will be fixed in the explosion station, then those of the other blasting charges one after another. After inlaying the blasting charges 25, the bore hole 24 will be closed from the side of the entry 23 by the choking plug 26, this plug will be fixed by a wedge. Then the recess between the lowest blasting charge 25 and the bore hole mouth will be filled with a filler, e.g. with sand gun or with sacked sand stemming, and the stemming will be fixed by the prop or sprag 27. After that, explosion breaking will be performed in series by the simultaneous firing of the detonating cords 6 of the detonators 5.

We claim:

1. A breaking apparatus for steep dip strong-coal deposits in an explosive atmosphere, comprising a succession of explosive units spaced apart within a bore hole, each of said explosive units including a core tube, an explosive charge body surrounding said core tube, an igniter anchored in said charge body and having a conductor extending into said charge body through the respective core tube, and means for maintaining an arc-suppressing heat-dissipating fluid all around said charge body and said core tube, the conductors of the igniters more remote from an inlet of said bore hole traversing the core tubes of each of the units more proximal to said inlet, each of said units being provided with means for anchoring same at a selected location along said bore hole.

2. The apparatus defined in claim 1 wherein each of said units includes a frustoconical bushing at an upper end thereof enabling said units to be pushed up into said bore hole;

a cylindrical casing affixed to said bushing and enclosing said medium, said casing being closed at its upper and lower ends by respective discs traversed by said core tube;

a pipe received in said casing in an axially surrounding said core tube and enclosing said charge body, said pipe being closed at its upper and lower ends; and an extension affixed to a lower end of said casing and retaining a spring forming said means for anchoring said unit in said bore hole.

3. A method of breaking strong coal from a steep dip strong-coal deposit in the presence of an explosive environment, comprising the steps of:

forming at least one upwardly directed bore hole from an inlet in said deposit;

successively passing respective explosive units into said bore hole, each of said units comprising a core tube, an explosive charge body surrounding said core tube, an igniter anchored in said charge body and having a conductor extending into said charge body through the respective core tube, and means for maintaining an arc-suppressing heat-dissipating fluid all around said charge body and said core tube, the conductors of the igniters more remote from an inlet of said bore hole traversing the core tubes of each of the units more proximal to said inlet, each of said units being provided with means for anchoring same at a selected location along said bore hole;

anchoring said units in a spaced relation along said bore at distances greater than the explosive range of each of said charge bodies;

leading said conductor from said units through said core tubes out of said inlet; and successively firing said units.

* * * * *